US006682692B1

(12) United States Patent
Yrjänäet al.

(10) Patent No.: US 6,682,692 B1
(45) Date of Patent: Jan. 27, 2004

(54) APPARATUS FOR SUPPORTING MATERIAL TO BE TREATED IN CONTINUOUSLY OPERATED THERMAL TREATMENT FURNACES

(75) Inventors: Taisto Yrjänä, Tornio (FI); Heikki Uurtamo, Tornio (FI); Jussi Yli-Niemi, Tornio (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/049,154

(22) PCT Filed: Aug. 3, 2000

(86) PCT No.: PCT/FI00/00666

§ 371 (c)(1),
(2), (4) Date: Apr. 26, 2002

(87) PCT Pub. No.: WO01/11093

PCT Pub. Date: Feb. 15, 2001

(30) Foreign Application Priority Data

Aug. 4, 1999 (FI) ..... 19991669

(51) Int. Cl.[7] ..... C21D 9/56
(52) U.S. Cl. ..... 266/274; 432/246
(58) Field of Search ..... 266/274, 276; 432/236, 3, 59, 246

(56) References Cited

U.S. PATENT DOCUMENTS 4,049,372 A * 9/1977 Bloom ..... 432/246
4,538,986 A 9/1985 Blomqvist et al.
5,938,431 A * 8/1999 Thevent et al. ..... 432/59
6,132,101 A * 10/2000 Landy, III ..... 384/559
6,471,509 B2 * 10/2002 Ruiter ..... 432/59

FOREIGN PATENT DOCUMENTS

| | | |
|---|---|---|
| EP | 0 862 033 | 9/1998 |
| WO | 00/40766 | 7/2000 |

* cited by examiner

*Primary Examiner*—Scott Kastler
(74) *Attorney, Agent, or Firm*—Smith-Hill and Bedell

(57) ABSTRACT

The invention relates to an apparatus for supporting material to be treated in continuously operated thermal treatment furnaces, wherein the support of the material is carried out by means of support elements external to the furnace, and where the material is made to proceed at a high velocity, said apparatus comprising at least two elements for supporting the material and a member for supporting the support element, as well as means for cooling the support element. According to the invention, the support element comprises at least one rotation support member provided with a turnably installed tightening element, and at least one actuator arrangement for making the support element rotate essentially at an equal circumferential velocity as the proceeding direction of the material.

5 Claims, 2 Drawing Sheets

APPARATUS FOR SUPPORTING MATERIAL TO BE TREATED IN CONTINUOUSLY OPERATED THERMAL TREATMENT FURNACES

The present invention relates to an apparatus for supporting the material to be treated in continuously operated thermal treatment furnaces, where the supporting of the material is realized by support elements external to the furnace.

From the FI patent 67,726, there is known a material support device to be used in thermal treatment furnaces, wherein on the circumference of a cooled roll, there are placed at least two cooled rolls with essentially smaller diameters. The larger roll, serving as the support device, is installed externally to the thermal treatment furnace, or between two successive thermal treatment furnaces, so that the supporting proper of the material is carried out by means of one circumferentially placed roll at a time. The roll located on the circumference of the larger roll rotates at the rotational velocity of the material to be supported, whereas the mutual position of the circumferentially installed rolls can be adjusted by means of an actuator arrangement connected to the larger roll.

In the support apparatus according to the FI patent 67,726, the roll placed on the circumference of the larger roll is made to rotate only by means of the material to be supported. Thus it is most likely that surface damages are caused in the material to be supported, owing to the difference in velocity between the roll and the material to be supported, at a stage when the roll is shifted to the supporting position or away therefrom.

The object of the present invention is to eliminate some of the drawbacks of the prior art and to realize and advanced supporting apparatus for material to be treated in thermal treatment furnaces wherein the element used for support can be made to rotate also without the co-effect of the material to be supported. The essential novel features of the invention are apparent from the appended claims.

In the material support apparatus according to the invention, to be used in a continuously operated thermal treatment furnace, against one and the same support member there are advantageously supported at least two support elements, which are positioned symmetrically with respect to said support member, so that those parts of the support elements that are located furthest away from each other are located on the circumference of one and the same circle. Moreover, the support member is installed so that by rotating the support member around its axis, the support element positioned in the supporting position is advantageously made to change places with another support element that was advantageously placed in the replacement position. In addition, around the support element there are provided means that at least partly support the material to be treated in the continuously operated thermal treatment furnace during the mutual exchange of positions of the support elements. According to the invention, the support element is provided with an actuator arrangement, whereby the support element can be made to rotate prior to the mechanical contact between the support element and the material to be supported. By means of the actuator arrangement, the rotating of the support element also is made to stop after the support element is shifted away from the supporting position with respect to the material to be supported. In order to realize an advantageous operation of the actuator arrangement, the support element is provided with at least one rotation support member, which can be replaced without having to detach the support element from the supporting position.

In the support apparatus according to the invention, in each support element there is advantageously connected an actuator arrangement whereby in the support element, there can be created a circumferential velocity that is essentially equal to the proceeding velocity of the material to be supported. When the support element in its support position moves at a velocity essentially equal to the velocity of the material to be supported, a better surface quality is obtained in the material to be supported, because the heating of the support element—caused by a difference in velocity—does not take place. Consequently the support element itself is not subjected to damages that would be caused by the difference in velocity.

According to the invention, the support element is advantageously made to rotate by means of the actuator arrangement, essentially simultaneously as the shifting of the support element from the replacement position to the supporting position is started. Thus, when the support element reaches the supporting position, the circumferential velocity of the support element is essentially equal to the proceeding velocity of the material to be supported, essentially at the same moment when the support element and the material to be supported are set in a mechanical contact. The circumferential velocity generated by means of the actuator arrangement of the support element can be maintained by said actuator arrangement essentially throughout the period that the support element is in the support position, but the actuator arrangement can also be switched off, in which case the support element is allowed to rotate only by the circumferential velocity rendered by the material to be supported. In case the actuator arrangement is switched off while the support element is in the support position, it is again switched on prior to shifting the support element away from the support position, in order to enable the moving of the support element away from the support position without a velocity difference between the circumferential velocity of the support element and the proceeding velocity of the material to be supported.

In the support apparatus according to the invention, also one and the same actuator arrangement can advantageously be used for controlling several support elements in order to generate and advantageous circumferential velocity, when so desired. A common actuator arrangement can be applied for instance in an apparatus of two support elements, so that the need of both support elements to use the actuator arrangement is stopped, when one is in the support position and the other is in the replacement position. When the replacing is started, both support elements are set to rotate essentially simultaneously, so that when one support element is leaving the support position and the other is entering the support position, both support elements rotate at a desired circumferential velocity with respect to the material to be supported. When the replacing is completed, the operation of the actuator arrangement of the support elements is again stopped, and the support element placed in the support position rotates by the velocity generated by the material to be supported. On the other hand, the support element placed in the replacement position is stopped, and thus enables the replacing of said support element.

When employing, in connection with the support element of the support apparatus according to the invention, an actuator arrangement whereby the circumferential velocity of the support element can be adjusted to be preferably essentially equal to the proceeding direction of the material to be supported, also the working life of the support element itself is extended, because now possible damages caused in the surface of the support element by heating, as a result of the velocity difference between the material to be supported and the support element, can be avoided when placing the support element in the support position.

According to the invention, in order to enable an advantageous use of the actuator arrangement, the support element is further provided with at least one rotation support member, i.e. bearing, whereby also the replacing of a support element with another can be carried out essentially quicker than in the prior art. The bearing connected to the support element is provided with a tightening element which is turnably installed between the locking position and the bearing replacement position. At the same time, the tightening element of the support element constitutes part of the bearing housing. Now, when a bearing should be replaced, the locking of the tightening element is opened, and the tightening element is turned to the replacement position, so that the bearing can be removed and replaced with a new one. By means of the turnably operated tightening element, the replacing of the bearing can be carried out advantageously quickly, and only a short interruption is caused in the thermal treatment process owing to the replacing of the bearing, because it can be carried out while the support element is in the support position. Moreover, the cooling provided in the support element extends the working life of the bearing, because the bearing is made more durable due to the more even temperature. By aid of the bearing system, also the actuator arrangement connected to the support element and the support element circumferential velocity generated thereby can advantageously be maintained and adjusted when necessary.

BRIEF DESCRIPTION OF THE DRAWINGS

The invention is explained in more detail with reference to the appended drawings, where.

Figure 1:
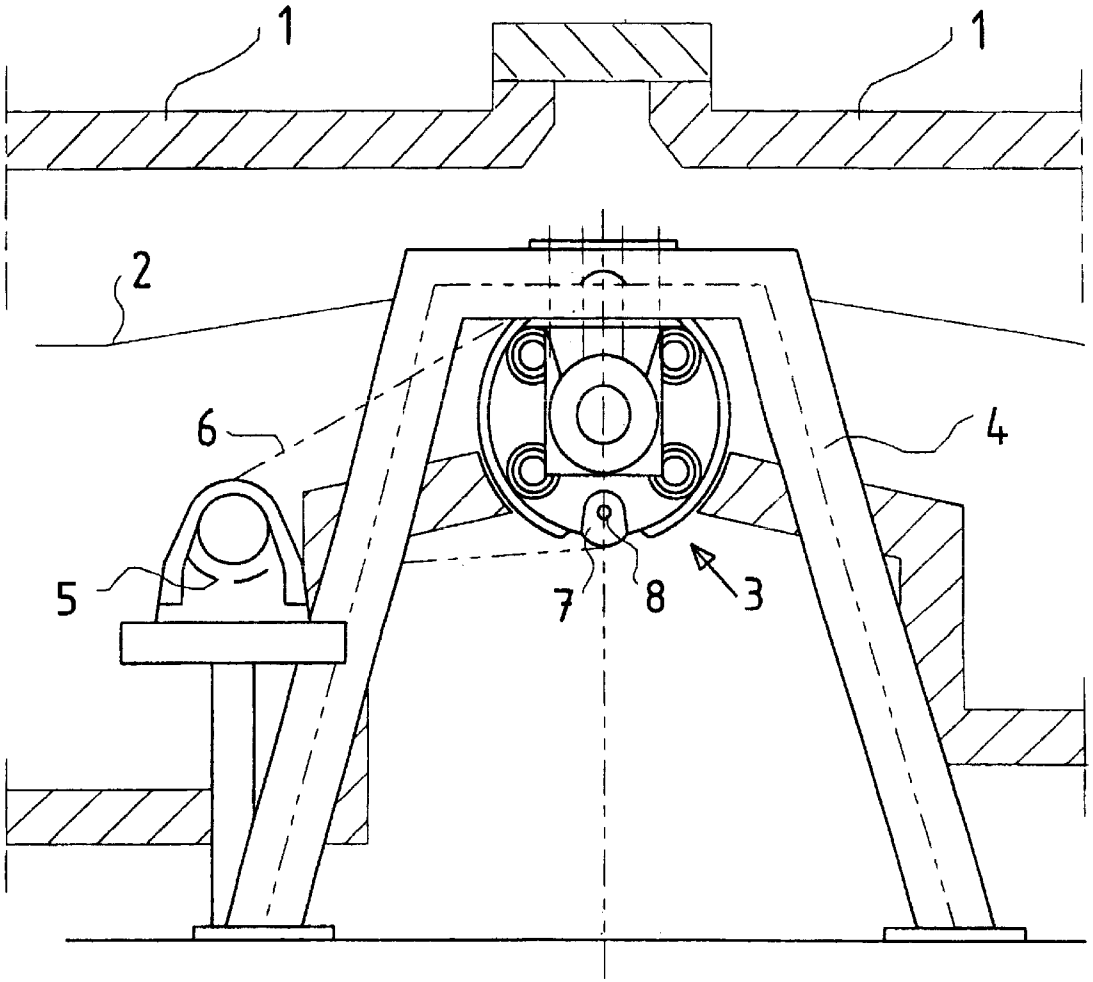
FIG. 1 illustrates a preferred embodiment of the invention, seen from the side.
Figure 2:
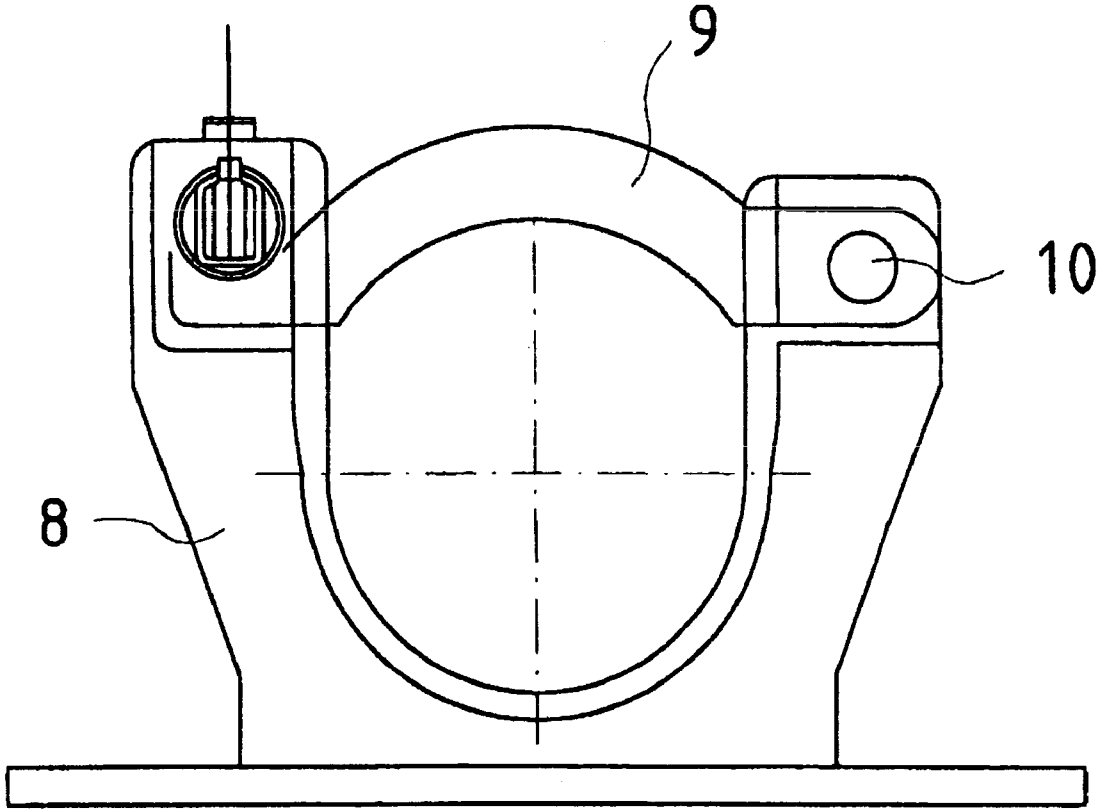
FIG. 2 illustrates a detail of the embodiment according to FIG. 1, seen from the side.

According to FIGS. 1 and 2, in the support structures 4 of a support apparatus 3 for material 2 to be treated in thermal treatment furnaces 1, there is attached a motor 5, which is connected, by chain transmission 6, to a support element 7. Around said support element 7, there also is installed a bearing 8, which is secured in its locking position by means of a tightening element 9. The tightening element 9 is further installed, with respect to the bearing 8, so that the tightening element 9 is turnable to its replacement position by means of an axis 10 provided between the bearing 8 and the tightening element 9.

What is claimed is:

1. An apparatus for supporting material to be treated in a continuously operated thermal treatment furnace, wherein the support of the material is carried out by means of support elements external to the furnace, and where the material is made to proceed at a high velocity, said apparatus comprising at least two elements for supporting the material and a member for supporting the support element, as well as means for cooling the support element, wherein the support element comprises at least one rotation support member, provided with a turnably installed tightening element, and with at least one actuator arrangement for making the support element rotate essentially at an equal circumferential velocity as the proceeding velocity of the material, and the tightening element of the rotation support member constitutes part of the support element housing.

2. An apparatus according to claim 1, wherein the actuator arrangement controls at least two support elements.

3. An apparatus for supporting material moving through a continuously operated thermal treatment furnace, which apparatus comprises:

a generally cylindrical support member having a central axis, a frame for supporting the support member for rotation about said central axis, at least two support elements supported by said support member for rotation about respective axes and positioned equidistant from the central axis of said support member and equiangularly from each other about said central axis, and an actuator arrangement for rotating said support elements about the respective axes of rotation.

4. An apparatus according to claim 3, wherein each support element is attached to the support member by a bearing structure that comprises a base member for receiving the support element and a tightening member that is secured to the base member and is turnable relative to the base member between a locking position in which the bearing structure retains the support element and a replacement position in which the bearing structure releases the support element.

5. An apparatus according to claim 4, wherein the base member is a U-shaped member that is attached to the support member and has first and second opposite limbs, the tightening member has first and second opposite ends and is turnably attached at its first end to the first limb of the U-shaped member, whereby the tightening member is turnable between the locking position, in which the second end of the tightening member engages the second limb of the U-shaped member, and the replacement position, in which the second end of the tightening member is spaced from the second limb of the U-shaped member, and the support element is received between the first and second limbs of the U-shaped member.

* * * * *